United States Patent [19]

Thiele

[11] 4,320,263

[45] Mar. 16, 1982

[54] DYNAMIC TRANSDUCER WITH MOVING COIL IN AN AIR GAP FILLED WITH MAGNETIC LIQUID

[75] Inventor: Karl-Heinz Thiele, Peine-Stederdorf, Fed. Rep. of Germany

[73] Assignee: Licentia Patent-Verwaltungs GmbH, Fed. Rep. of Germany

[21] Appl. No.: 109,184

[22] Filed: Jan. 2, 1980

[30] Foreign Application Priority Data

Jan. 8, 1979 [DE] Fed. Rep. of Germany ..... 2900427

[51] Int. Cl.[3] ..... H04R 9/02

[52] U.S. Cl. ..... 179/115.5 VC

[58] Field of Search ..... 179/115.5 VC

[56] References Cited

FOREIGN PATENT DOCUMENTS 2716063 10/1978 Fed. Rep. of Germany ... 179/115.5 VC

*Primary Examiner*—George G. Stellar

*Attorney, Agent, or Firm*—McGlew and Tuttle

[57] ABSTRACT

A dynamic electroacoustic transducer comprising a magnetic pole case defining a magnetic air gap, a coil movably mounted in the air gap and spaced from the magnetic pole case with magnetic liquid extending between the coil and the case in the air gap. A diaphragm is connected to the coil and attached peripherally to the magnetic pole casing so that airtight spaces are defined above and below the coil which are in communication with each other. The airtight sealing of the spaces prevents the liquid portions of the magnetic liquid to evaporate which would result in deterioration of the characteristics of the dynamic electroacoustic transducer.

5 Claims, 2 Drawing Figures

DYNAMIC TRANSDUCER WITH MOVING COIL IN AN AIR GAP FILLED WITH MAGNETIC LIQUID

FIELD AND BACKGROUND OF THE INVENTION

The present invention relates in general to sound transducers, and in particular to a new and useful dynamic loudspeaker which utilizes a magnetic liquid sealed in a gastight space to avoid deterioration in the characteristics of the loudspeaker.

Dynamic loudspeakers are known (Instra. A. Control Syst. 48, 1975, 10 pages 41 to 44), which includes air space in which the voice coil of the dynamic system is movable. The space is designated an "air gap" of the magnetic pole case and is filled with a magnetic liquid. The magnetic liquid is held in place in the gap by the permanent magnetic field of the magnetic pole case. The liquid serves the purpose of improving the acoustic properties, particularly the distortion factor and the phase delay of the loudspeaker system. Also, the manufacture of the loudspeaker is simplified since the dimensional variations allowable in manufacture take on a less significant effect. The filling imparts properties to the "air gap" which are close to properties of the magnetic poles themselves. The air gap is thereby reduced to zero, as intended.

Another substantial advantage over dynamic systems without a filled air gap are improved thermal conditions. As compared to air, the thermal conductivity of the magnetic liquid is very much higher, so that resistance to heat transmission between the coil and the magnetic pole case is reduced. This increases the maximum admissible input power, considered at equal maximum temperatures of the moving coil.

SUMMARY OF THE INVENTION

The present invention is directed to an improvement of a dynamic transducer of the above-mentioned kind. The particular goal is to ensure that the properties of the transducer do not change over a long period of time.

The invention is based on the following idea: The magnetic liquid in the air gap of the magnetic system is heated by the moving coil. Due to this heat, the magnetic liquid evaporates. Even if a carrier liquid having a low partial pressure is employed for the magnetic liquid, the carrier liquid may partly evaporate in the course of time. In the inventive arrangement, a balance can establish in the gastight space around the magnetic liquid, between the degree of saturation of the air and the partial pressure of the carrier liquid. To prevent gas molecules from escaping from the enclosed space, the material forming the boundary should meet the requirement of having a pore size which is smaller than the so called mean free path of the evaporated molecules of the carrier liquid at operating temperatures of the loudspeaker system. If, relative to the mean free path of the molecules, the pore size is smaller by orders of magnitude, an escape of the molecules is practically completely prevented. A sufficiently high resistance to flow then opposes the evaporated carrier liquid.

Accordingly, an object of the present invention is to provide an electroacoustic transducer comprising a magnetic pole case defining a magnetic air gap, a coil movably mounted in the air gap and spaced from the pole case, magnetic liquid extending between the coil and the case in the air gap, and diaphragm means connected to the coil and to the case defining with the case a space above and below the magnetic liquid which is gastight.

A further object of the invention is to provide a dynamic electroacoustic transducer in the form of a tweeter which includes a dome shaped diaphragm made of plastic or aluminum.

A still further object of the present invention is to provide an electroacoustic transducer in the form of a loudspeaker having a diaphragm with a central dome portion and a peripheral cone portion, the movable coil also connected with a centering diaphragm to the magnetic casing with the centering diaphragm defining the upper space above the magnetic liquid and made of gastight material such as rubber.

A still further object of the present invention is to provide a dynamic electroacoustic transducer which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
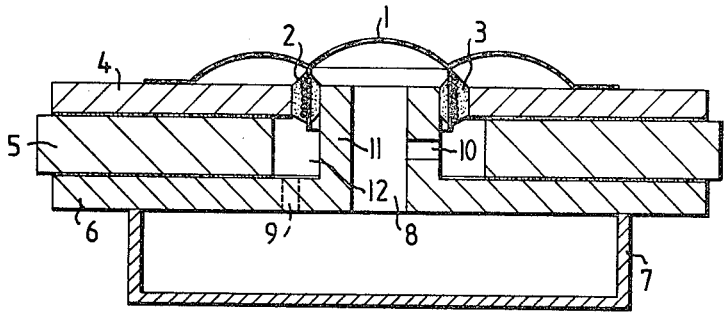
FIG. 1 is a side sectional view of an inventive dome-type tweeter.

FIG. 1 shows an electrodynamic dome-type high-frequency or tweeter type loudspeaker comprising a dome diaphragm 1 and a moving coil 2 for driving the diaphragm 1. The magnetic pole case is assembled of a base 6 with a pole core 11, an annular permanent magnet 5, and an upper pole plate 4. Pole plate 4 surrounds pole core 11 and forms an air gap 3 within which the voice coil 2 is movable. The free space between moving coil 2 and pole plate 4, on the one hand, and moving coil 2 and pole core 11, on the other hand, is filled with a magnetic liquid 3 over the entire circumference of the moving coil 2. Thereby, an enclosed hollow space 12 is formed beneath moving coil 2. Pole core 11 has a central bore 8 providing communication between the air space below dome 1 and a resonance cavity provided below base 6 and formed by a casing 7. This arrangement serves the purpose of adjusting the frequency of the loudspeaker system.

The hollow space 12 formed beneath moving coil 2 communicates, through a bore 10, with central bore 8 of pole core 11, so that a pressure equalization is obtained between hollow space 12 and the substantially larger air space 7, 8. Instead of bore 10, a bore 9 may be provided in base 6 as shown in dotted lines in FIG. 1.

The material of which dome diaphragm 1 and casing 7 are made is selected to be of such nature as to prevent the gas enclosed by these parts from escaping or diffusing therethrough. Since base 6, magnet 5, and pole plate 4 are firmly cemented to one another over their entire contact surfaces, there is no risk of gas escaping through these joints.

Figure 2:
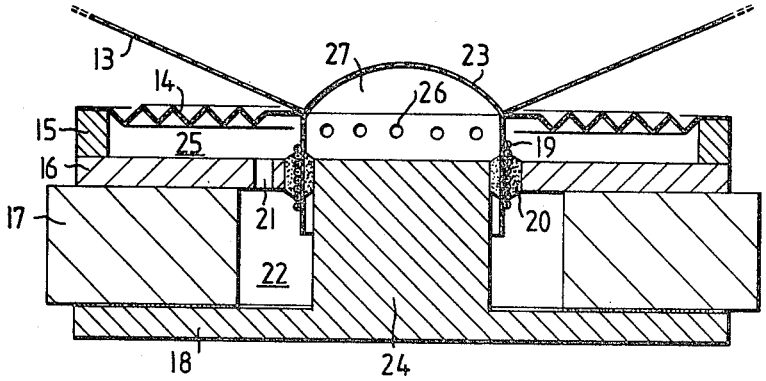
FIG. 2 is a side sectional view of a cone loudspeaker having the inventive features.

FIG. 2 shows another embodiment of the invention applied to a cone loudspeaker. In a similar way as in the tweeter of FIG. 1, this loudspeaker comprises a diaphragm 13, a moving coil 19, a pole plate 16, a permanent magnet 17, a base 18 with a pole core 24, and a magnetic liquid 20. Diaphragm 13, which is substantially larger, so that its outer securing is not shown, is centered in its bottom portion by means of a centering diaphragm 14, to prevent the moving coil from contacting pole core 24 or pole plate 16. The periphery of centering diaphragm 14 is secured to a ring 15 which is supported by pole plate 16. A dome 23 is cemented to the center of cone diaphragm 13. To permit pressure equalization, a bore 21 is provided below centering diaphragm 14, between hollow space 22 beneath moving coil 19 and the air space 25 beneath the centering diaphragm.

For the same purpose, space 27 below dome 23 communicates with the hollow space 25 formed beneath the centering diaphragm 14, through apertures 26 provided in the support of moving coil 19. The gas-filled spaces 22, 25, 27 are thus connected to each other through apertures, to equalize pressure variations in the individual spaces.

The gas present in spaces 22, 25, 27 is in contact with the magnetic liquid 20. Since gastight materials are used for centering diaphragm 14 and dome 23, gas molecules of the carrier liquid of magnetic liquid 20 cannot escape. As soon as the air in space 22, 25, 27 is saturated with gas molecules of the carrier liquid, the carrier liquid no longer evaporates. In this way, the amount and composition of the magnetic liquid is maintained constant. This ensures that the quality of the system remains unchanged for a long period of time. Suitable materials for diaphragm 1 in FIG. 1 and centering diaphragm 14 in FIG. 2 are, for example, plastics, such as PVC, metal foils, such as aluminum, or sealed paper. The dome 23 in FIG. 2 is preferably metallic, for example, aluminum.

While specific embodiments of the invention have been shown and described in detail to illustrate the application of the principles of the invention, it will be understood that the invention may be embodied otherwise without departing from such principles.

What is claimed is:

1. An electroacoustic transducer comprising, a magnetic pole case defining an air gap, a coil movably mounted in the air gap and spaced from the magnetic pole case, magnetic liquid extending between the coil and the case in the air gap, and a diaphragm connected to the coil and to the case defining with the case a sealed space above and below the magnetic liquid which is gastight, the diaphragm and case defining the sealed spaces being made of material having a pore size substantially less than a mean free path of molecules of magnetic liquid evaporated from the magnetic liquid in said air gap.

2. An electroacoustic transducer according to claim 1, wherein said diaphragm comprises a central dome portion and a peripheral portion connected between the dome portion and the magnetic pole case.

3. An electroacoustic transducer according to claim 2, wherein said dome portion is made of a material chosen from the group consisting of plastic and metal.

4. An electroacoustic transducer according to claim 1, wherein said diaphragm comprises a central dome portion, a peripheral cone portion connected to said dome portion and extending therefrom and a centering flexible diaphragm connected to said coil and to said magnetic pole case for centering said coil in said air gap, said centering diaphragm defining said airtight space above the magnetic liquid and made of said material.

5. An electroacoustic transducer according to claim 4, wherein said centering flexible diaphragm is made of rubber.

* * * * *